United States Patent [19]

Lane

[11] 4,130,137

[45] Dec. 19, 1978

[54] FLUID DISTRIBUTION SYSTEM

[76] Inventor: William G. Lane, 34380 Mercer La., Fraser, Mich. 48026

[21] Appl. No.: 817,157

[22] Filed: Jul. 20, 1977

[51] Int. Cl.[2] ..... F15B 13/08

[52] U.S. Cl. ..... 137/884; 137/596.16

[58] Field of Search ..... 137/884, 596.16

[56] References Cited

U.S. PATENT DOCUMENTS 3,654,960 4/1972 Kiernan ..... 137/884

*Primary Examiner*—Gerald A. Michalsky

*Attorney, Agent, or Firm*—Gifford, Chandler, VanOphem, Sheridan & Sprinkle

[57] ABSTRACT

A hydraulic fluid distribution system comprising at least two generally rectangular distribution plates which are positioned end to end and adjacent each other. A fluid inlet port is formed on one side of each distribution plate while a fluid outlet port is formed on the opposite side of each plate whereby an elongated fluid manifold can simultaneously supply fluid pressure to all of the fluid inlet ports while a second and similar fluid manifold is connected to the other side of the distribution plates and fluidly communicates simultaneously with all of the outlet ports from the distribution plates. Each distribution plate is adapted to carry a fluid control device which fluidly communicates with the inlet and outlet ports.

8 Claims, 4 Drawing Figures

Fig-4
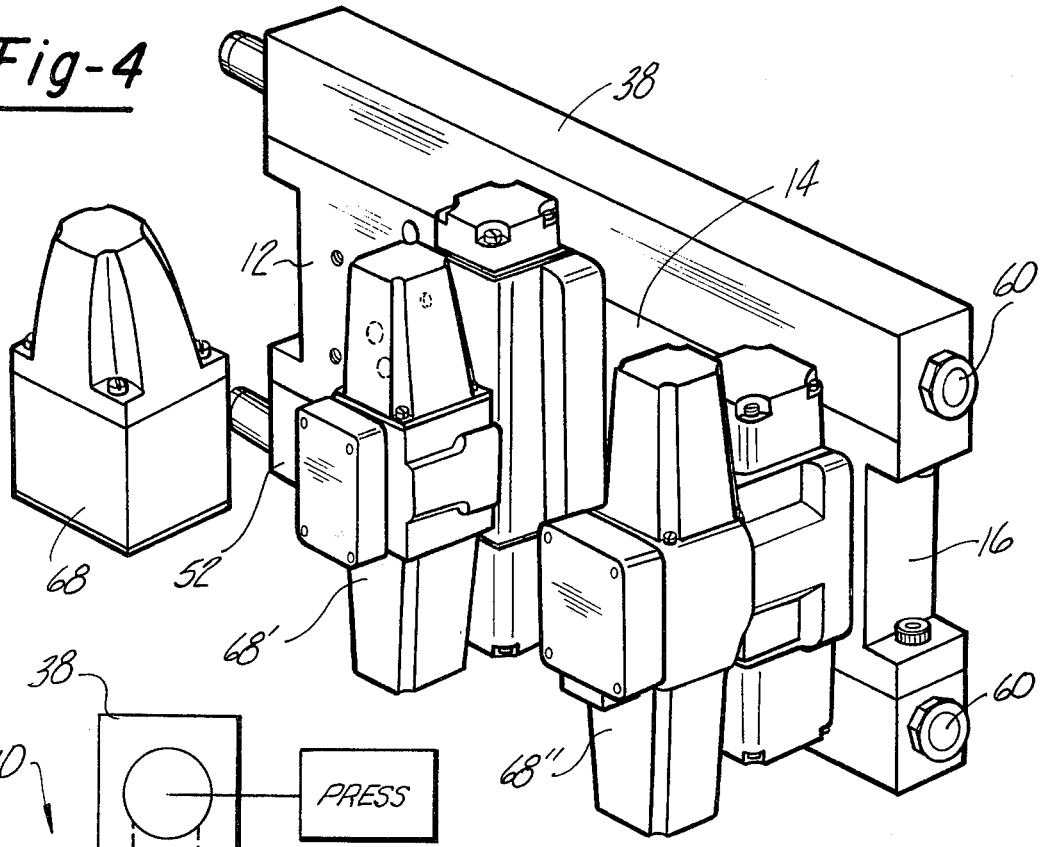
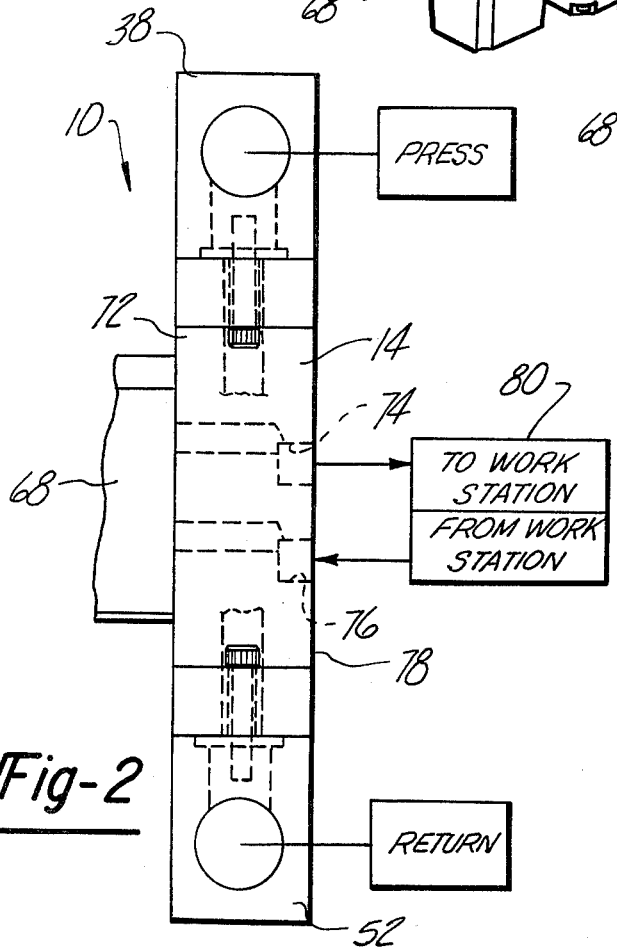
Fig-2
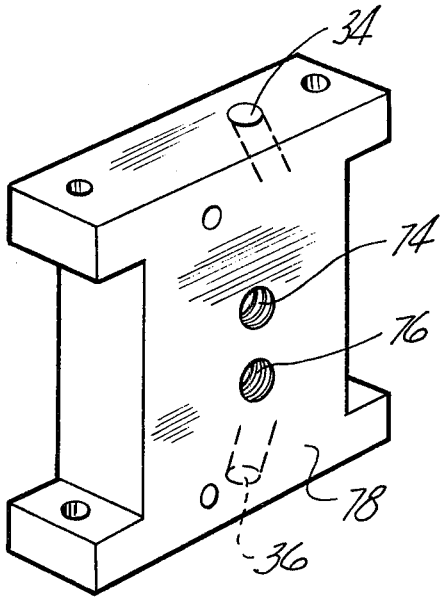
Fig-3

FLUID DISTRIBUTION SYSTEM

BACKGROUND OF THE INVENTION

I. Field of the Invention

The present invention relates generally to a fluid distribution system and more particularly to a hydraulic fluid distribution system.

II. Description of the Prior Art

In hydraulic fluid systems a hydraulic fluid pump is coupled to a fluid reservoir and generates high pressure hydraulic fluid at its outlet. The pump outlet is conventionally coupled to and through appropriate fluid control devices, such as speed reducers, flow controls, pressure reducing valves, and the like all of which control or modify the fluid pressure from the pump to a fluid powered device. For large hydraulic powered machinery, it is common to have a plurality of fluid control devices disposed between the hydraulic pump and the hydraulic machine. Although these fluid control devices vary from each other, each includes a fluid inlet port coupled to the hydraulic pump outlet and a fluid outlet port coupled to the fluid reservoir for the hydraulic pump.

It has been the previous practice in hydraulic machinery to directly and independently fluidly connect the hydraulic pump and reservoir with each of the fluid control devices by suitable conduits, typically steel tubing. While these previously known hydraulic fluid distribution systems are effective in operation, they become increasingly burdensome, complex and expensive when a plurality of fluid conrol devices are connected to a single hydraulic pump and reservoir. In particular, as the number of interconnections between the hydraulic pump, reservoir and the fluid control devices increase, both the material and labor costs for these previously known distribution systems increases dramatically. Moreover, due to the maze of hydraulic fluid conduits required by these previously known systems, maintenance on the hydraulic system is not only costly but results in prolonged periods of downtime for the machinery.

SUMMARY OF THE PRESENT INVENTION

The hydraulic fluid distribution system according to the present invention overcomes these above mentioned disadvantages of the previously known systems by providing a simple, inexpensive, rapidly assembled and yet totally effective hydraulic distribution system.

In brief, the distribution system according to the present invention comprises at least two and preferably a plurality of generally rectangular distribution or base plates, each of which is constructed to the same outer dimensions. Each distribution plate is adapted to carry one fluid control device and includes appropriate ports formed therethrough for connection with the fluid control device and external ports for connection with the fluid powered device or machine. Moreover, each distribution plate includes a fluid inlet port for connection with the hydraulic pump outlet at substantially the same longitudinal position on one side of the distribution plate. Similarly, a fluid outlet port for connection to the hydraulic fluid reservoir is formed in the opposite side of the distribution plate and substantially at the same longitudinal position for each outlet in each distribution plate.

The distribution plates are positioned end to end and adjacent each other so that the fluid inlet port side of each distribution plate registers with the others while, likewise, the fluid outlet port side of each distribution plate registers with the others. Thereafter, an elongated inlet manifold having a plurality of outlet ports is secured onto the inlet side of the multiple distribution plates so that outlet ports from the manifold register with and simultaneously fluidly communicate with the inlet ports to all of the distribution plates. Likewise, a second manifold is secured to and along the opposite side of the multiple distribution plate and includes a plurality of ports which register with the outlet ports from all of the distribution plates.

The first manifold is fluidly connected to the outlet from the hydraulic pump while the second manifold is connected with the hydraulic fluid reservoir. By this arrangement, a single hydraulic line from the hydraulic pump to the first manifold simultaneously fluidly connects the hydraulic pump with each of the fluid control devices while, likewise, a single fluid line fluidly connects all of the fluid control devices with the reservoir. The present invention thus eliminates the previously known multiple conduit connections between the hydraulic pump, the reservoir and all of the individual fluid control devices.

BRIEF DESCRIPTION OF THE DRAWING

A better understanding of the present invention will be had upon reference to the following detailed description when read in conjunction with the accompanying drawing wherein like reference characters refer to like parts throughout the several views, and in which:

FIG. 2 is a fragmentary partial sectional view illustrating a portion of the hydraulic distribution system according to the present invention and taken substantially along line 2—2 in FIG. 1;

FIG. 3 is a perspective view illustrating one distribution plate of the hydraulic distribution system of the present invention; and FIG. 4 is a perspective and partial diagrammatic view illustrating the hydraulic fluid distribution system of the present invention.

DETAILED DESCRIPTION OF THE PRESENT INVENTION

Figure 1:
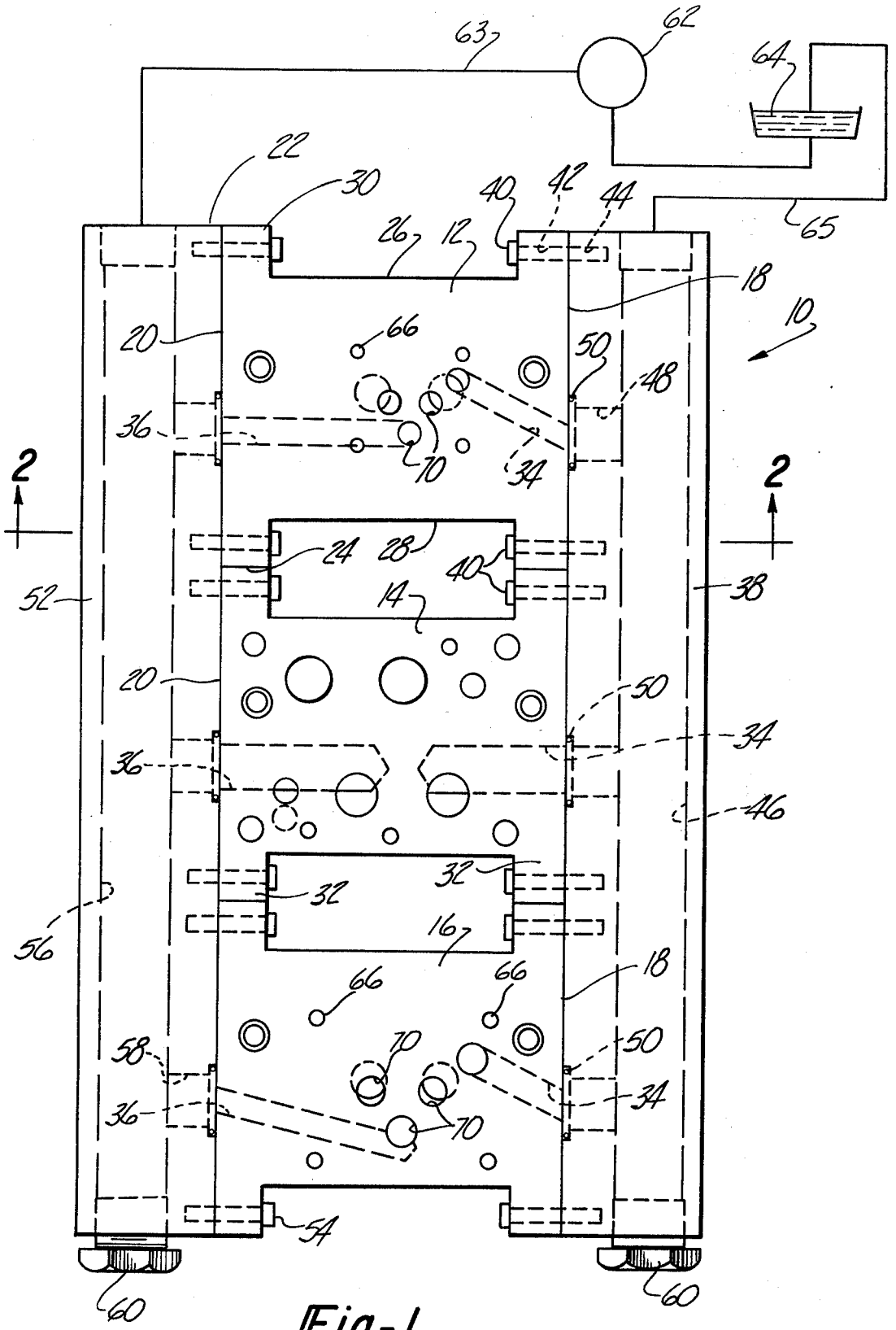
FIG. 1 is a top plan and partial diagrammatic view illustrating the hydraulic fluid distribution system according to the present invention.

With reference first to FIGS. 1–3, a hydraulic fluid distribution system 10 according to the present invention is thereshown and comprises a plurality of distribution or base plates 12, 14, and 16 which are generally rectangular in shape. Each base plate 12–16 includes a first or inlet side 18 and a second or outlet side 20, a top 22 and a bottom 24.

Each base plate 12–16 is constructed of aluminum or other suitable material and has the same overall outer dimensions. In addition, the base plates 12–16 are mounted in an end to end adjacent, and preferably abutting, relationship so that the first side 18 of the base plates 12–16 all lie in the same plane while, likewise, the second side 20 of the base plates 12–16 all lie in a second plane. In addition, for a reason to be shortly described, a rectangular channel 26 is removed from the top 22 of each base plate 12–16 while a rectangular channel 28 is removed from the bottom 24 of each base plate 12–16. The channels 26 and 28 thus respectively form two upper extending portions 30 and two lower extending portions 32 along each side 18 and 20 on each base plate 12–16.

A fluid inlet port 34 is open to the first side 18 of each base plate 12–16 at substantially the same longitudinal position along the side 18. Likewise an outlet port 36 is open along each side 20 and at the substantially same longitudinal position along each side 20 of each base plate 12–16. By this provision, despite the sequence of the base plates 12, 14 and 16, the fluid inlet ports 34 and fluid outlet ports 36 to and from the base plates 12–16 are equidistantly spaced from each other.

With reference now to FIGS. 1, 2 and 4 a first elongated fluid manifold 38 is positioned against the first side 18 of all of the base plates 12–16. The fluid manifold 38 is tightly secured to the base plates 12–16 by bolts 40 extending through lateral bores 42 in the extending portions 30 and 32 of the individual base plates 12–16 and threadably engaging registering threaded bores 34 formed in the manifold 38. The rectangular channels 26 and 28 across the top 22 and bottom 24 of each base plate 12–16 provides adequate access to manually tighten the individual bolts 40.

A through bore 46 is formed axially through the manifold 38 while equidistantly spaced radial ports 48 fluidly connect the axial bore 46 with the fluid inlet ports 34 on the individual base plates 12–16. Since the fluid inlet ports 34 on the base plates 12–16 are equidistantly spaced from each other a distance equal to the length of the base plates 12–16, the radial ports 48 in the fluid manifold 38 are likewise equidistantly spaced in the same lineal amount. In addition, appropriate 0-rings 50 positioned around the junction of each radial port 48 and each base plate inlet port 34 prevents fluid leakage between the manifold 38 and the base plates 12–16.

A second fluid manifold 52, substantially identical to the first, is attached tightly against the other side 20 of the base plates 12–16. The second manifold 52 is coupled by appropriate bolts 54 to the base plates 12–16 in the same fashion as the first manifold 38. Likewise, the second manifold 52 includes an axial throughbore 56 which is fluidly connected with the outlet ports 36 from the base plates 12–16 by equidistantly spaced radial ports 58. Preferably, the inlet and outlet ports 34 and 36 in each base plate 12–16 are laterally in alignment with each other so that the manifolds 52 and 38 can be interchangeably utilized.

The lower end of each manifold 52 and 38 is closed by an appropriate plug 60. The upper end of the second manifold 52 is fluidly coupled by a line 63 to the outlet from a hydraulic pump 62 while the upper end of the first manifold 38 is fluidly coupled by a line 65 to a reservoir 64 for the hydraulic pump 62. By this arrangement, hydraulic fluid pressure from the pump 62 is supplied to each of the base plates 12–16 simultaneously via the line 63 and the manifold 52 while, similarly, the fluid outlet 36 from each base plate 12–16 is simultaneously fluidly coupled to the reservoir 64 via the first manifold 38 and the fluid line 65.

With reference now to FIGS. 1 and 4, a plurality of mounting holes 66 are provided on the outer side of each base plate 12–16 and are preferably internally threaded. The threaded holes 66 form mounting holes for a fluid control device 68 which can be a pressure reducer, speed reducer, flow controller, or the like. The control device 68 illustrated is a direct operated valve. It will be understood, however, that other fluid control devices, such as a ¾ inch pilot operated valve 68′ or a ⅜ inch pilot operated valve 68″ can also be employed as required or desired.

Once attached to the base plates 12–16, the fluid control devices 68, 68′, and 68″ fluidly communicate with ports 70 in each base plate 12–16. Moreover, as is known by those skilled in the art, the position not only of the mounting holes 66 but of also the fluid ports 70 for connection with the fluid control devices 68 is standardized throughout the industry for a given port size of the fluid device 68. Thus, for example, both the mounting holes 66 and ports 70 will be identical for all fluid devices 68 having the same port size and the port sizes for the fluid devices 68 are also standardized.

With reference now to FIGS. 2 and 3, one fluid control device 68 is secured to the front side 72 of the base plate 14. A pair of fluid ports 74 and 76 are formed on the other side 78 of the base plate 14 for fluid connection to and from, respectively, the hydraulic powered machine 80 (illustrated only diagrammatically). Each base plate 12–16 includes the same fluid port 74 and 76 and it will also be understood that the ports 74 and 76 can be intercoupled between the various base plates 12–16 rather than directly to the hydraulic powered device 80.

The hydraulic fluid distribution system 10 of the present invention thus achieves substantial advantages over the previously known distribution systems by providing the base plates 12–16 and manifolds 38 and 52 whereby a pair of fluid lines 63 and 65 can simultaneously supply hydraulic fluid to and from a plurality of fluid control devices 68. Moreover, although the distribution system 10 of the present invention has been described by way of three base plates 12–16 mounted end to end, it will be appreciated that more or fewer base plates can be secured together as required.

The distribution system according to the present invention thus cannot only be more rapidly and inexpensively constructed than the previously known systems but, in addition, maintenance can be carried out by simple replacement of the defective component. This is possible since each of the base plates 12–16 is dimensionally equivalent to the other so that both the base plates 12–16, fluid control devices 68, and the manifolds 52 and 30 are interchangeable with each other.

Having thus described my invention may modifications thereto will become apparent to those skilled in the art to which it pertains without deviation from the spirit of the invention as defined by the scope of the appended claims.

I claim:

1. A fluid distribution system comprising at least two fluid distribution plates, each plate having two side surfaces, a top and bottom surface and a front and a back surface, a fluid inlet port means formed in one side of each distribution plate, a fluid outlet port means formed in the other side of each distribution plate, means for mounting fluid control means on each base plate, means for mounting said fluid distribution plates end to end and adjacent each other, a first fluid manifold having at least two outlet ports and first means for fastening said first manifold to one side of said distribution plates whereby said first manifold outlet ports fluidly communicate with said fluid inlet port means on said distribution plates, and a second fluid manifold having at least two inlet ports and second means for fastening said second manifold to the other side of said distribution plates whereby said second manifold inlet ports fluidly communicate with said fluid outlet port means on said distribution plates.

2. The invention as defined in claim 1 wherein said fluid inlet port means are substantially identically longitudinally positioned on said first mentioned side of each distribution plate.

3. The invention as defined in claim 2 wherein said fluid outlet port means are substantially identically longitudinally positioned on said second mentioned side of each distribution plate.

4. The invention as defined in claim 3 wherein each distribution plate is substantially rectangular in shape and wherein said first and second sides are opposite sides of each rectangular distribution plate.

5. The invention as defined in claim 4 wherein said fluid inlet port means is in lateral alignment with said fluid outlet port means.

6. The invention as defined in claim 4 wherein said first manifold flatly abuts against and is secured to said first side of said distribution plates and wherein said second manifold flatly abuts against and is secured to said second side of said distribution plates.

7. The invention as defined in claim 6 wherein each manifold is elongated and includes an axial bore and a plurality of equidistantly spaced radial ports which fluidly connect with said axial bore.

8. The invention as defined in claim 4 wherein each distribution plate includes upwardly and downwardly extending portions on each side and wherein said first and second fastening means comprises threaded fasteners extending through bores formed in said extending portions and threadably engaging threaded bores in said first and second manifold, respectively.

* * * * *

UNITED STATES PATENT AND TRADEMARK OFFICE

CERTIFICATE OF CORRECTION

PATENT NO. : 4,130,137

DATED : December 19, 1978

INVENTOR(S) : William G. Lane

It is certified that error appears in the above-identified patent and that said Letters Patent are hereby corrected as shown below:

Column 4, line 45, delete "may", and insert --many--.

Signed and Sealed this

*Sixth* Day of *March 1979*

[SEAL]

*Attest:*

RUTH C. MASON
*Attesting Officer*

DONALD W. BANNER
*Commissioner of Patents and Trademarks*